US006199039B1

(12) United States Patent
Chen et al.

(10) Patent No.: US 6,199,039 B1
(45) Date of Patent: Mar. 6, 2001

(54) SYNTHESIS SUBBAND FILTER IN MPEG-II AUDIO DECODING

(75) Inventors: Liang-Gee Chen; Tsung-Han Tsai, both of Taipei; Yuan-Chen Liu, Taipei Hsien, all of (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 09/128,015

(22) Filed: Aug. 3, 1998

(51) Int. Cl.[7] ..... G10L 21/06; G10L 13/04; G10L 19/02

(52) U.S. Cl. ..... 704/229; 704/201; 704/236; 704/258; 704/269; 704/268

(58) Field of Search ..... 367/197, 198; 704/500–504, 206, 204, 229, 230, 226, 222, 201, 236, 258, 268, 269; 381/173, 150; 369/124, 147; 375/240; 341/143, 110, 117, 144

(56) References Cited

PUBLICATIONS

Tsung–Han Tsai, Liang–Gee Chen and Yuan–Chen Liu, "A Novel MPEG–2 Audio Decoder with Efficient Data Arrangement and Memory Configuration" Jun. 1997.*

Tsung–Han Tsai, Thou–Ho Chen and Liang–Gee Chen, "An MPEG Audio Decoder Chip", IEEE Nov. 1995.*

Tsung–Han Tsai, Thou–Ho Chen and Liang–Gee Chen, Design and VLSI Implementation of MPEG Audio Decoder, Jun. 1995.*

Tsung–Han Tsai, Liang–Gee Chen and Ruei–Xi Chen, "Implementation Strategy of MPEG–II Audio Decoder and Efficient Multichannel Architecture", IEEE Nov. 1997.*

* cited by examiner

*Primary Examiner*—Richemond Dorvil
*Assistant Examiner*—Daniel A Nolan
(74) *Attorney, Agent, or Firm*—Bacon & Thomas, PLLC

(57) ABSTRACT

An MPEG-II audio decoder with a synthesis subband filter includes a fast IMDCT (Inverse Modified Discrete Cosine Transform) module and an IPQMF (Inverse Pseudo Quadrature Mirror Filter) module. The fast IMDCT module involves a butterfly stage of input subband samples which requires only about ¼ the amount of multiplier-accumulate computation of the ISO suggested method. The IPQMF module involves an efficient memory configuration which requires only half size of the standard synthesis subband filter bank.

1 Claim, 8 Drawing Sheets

Starting Block ↓ Ending Block ↓

| | | | | | | | | | | | | | | | | | |
|---|---|---|---|---|---|---|---|---|---|---|---|---|---|---|---|---|---|
| IPQMF cycle0 | 0 | 3 | 4 | 7 | 8 | 11 | 12 | 15 | 16 | 19 | 20 | 23 | 24 | 27 | 28 | 31 | Block Sequence |
| IPQMF cycle1 | 2 | 5 | 6 | 9 | 10 | 13 | 14 | 17 | 18 | 21 | 22 | 25 | 26 | 29 | 30 | 1 | |
| IPQMF cycle2 | 4 | 7 | 8 | 11 | 12 | 15 | 16 | 19 | 20 | 23 | 24 | 27 | 28 | 31 | 0 | 3 | |
| IPQMF cycle3 | 6 | 9 | 10 | 13 | 14 | 17 | 18 | 21 | 22 | 25 | 26 | 29 | 30 | 1 | 2 | 5 | |
| IPQMF cycle14 | 28 | 31 | 0 | 3 | 4 | 7 | 8 | 11 | 12 | 15 | 16 | 19 | 20 | 23 | 24 | 27 | |
| IPQMF cycle15 | 30 | 1 | 2 | 5 | 6 | 9 | 10 | 13 | 14 | 17 | 18 | 21 | 22 | 25 | 26 | 29 | |

Starting Block ↓ Ending Block ↓ → Block Sequence

| | | | | | | | | | | | | | | | | |
|---|---|---|---|---|---|---|---|---|---|---|---|---|---|---|---|---|
| IPQMF cycle0 | 0 | 3 | 4 | 7 | 8 | 11 | 12 | 15 | 16 | 19 | 20 | 23 | 24 | 27 | 28 | 31 |
| IPQMF cycle1 | 2 | 5 | 6 | 9 | 10 | 13 | 14 | 17 | 18 | 21 | 22 | 25 | 26 | 29 | 30 | 1 |
| IPQMF cycle2 | 4 | 7 | 8 | 11 | 12 | 15 | 16 | 19 | 20 | 23 | 24 | 27 | 28 | 31 | 0 | 3 |
| IPQMF cycle3 | 6 | 9 | 10 | 13 | 14 | 17 | 18 | 21 | 22 | 25 | 26 | 29 | 30 | 1 | 2 | 5 |
| IPQMF cycle14 | 28 | 31 | 0 | 3 | 4 | 7 | 8 | 11 | 12 | 15 | 16 | 19 | 20 | 23 | 24 | 27 |
| IPQMF cycle15 | 30 | 1 | 2 | 5 | 6 | 9 | 10 | 13 | 14 | 17 | 18 | 21 | 22 | 25 | 26 | 29 |

FIG. 8

SYNTHESIS SUBBAND FILTER IN MPEG-II AUDIO DECODING

FIELD OF THE INVENTION

The present invention relates to an MPEG-II audio decoder, and in particular to the synthesis subband filter in the MPEG-II audio decoder.

BACKGROUND OF THE INVENTION

The ISO MPEG-II audio standard has developed a worldwide standard audio coding algorithm, which can significantly reduce the requirements of transmission bandwidth and data storage with low distortion. With the recent advances in VLSI and ATM networking technology, the low-cost MPEG-II audio decoder in real-time system becomes more essential for multimedia applications.

The MPEG-II audio coding standard is an extension of MPEG-I. Emphasis of the new activity is on multichannel and multilingual audio and on an extension of the existing standard to lower sampling frequencies and lower bit rates. In addition, backward compatibility is a key aspect to ensure the existing two channel decoders will still be able to decode compatible stereo information from five multichannel signals. This implies the provision of compatibility matrices, using adequate inverse matrix coefficients.

The MPEG-II decoding flow chart is shown in FIG. 1. Also, within the synthesis subband filter, the inverse Modified Discrete Cosine Transform (IMDCT) $V_i$ of a sequence $S_k$ (where $N_i$ is the cosine function defined in equation (1), below), and the inverse Pseudo Quadrature Mirror Filter (IPQMF) $U_{ij}$ (defined as a function of IMDCT $V_i$, where $D_i$ is a standard windowing coefficient as defined the MPEG standard ISO CO 11172-3) will be realized, as shown in FIG. 2. The IMDCT module makes the perfect reconstruction feasible as a polyphase QMF transform kernel. The IPQMF module can be further decomposed into four functions, such as: shifting, rearranging, windowing and partial summation. According to the computation power analysis for MPEG-II audio decoding in Table 1, the computation load synthesis subband filter illustrated in FIG. 2 depends to a great extent on the realization of IMDCT module, while the IPQMF also induces substantial computation and some data arrangement. Moreover, the inverse quantization (IQ) and multichannel (MC) modules although occupying little of the computational load of the whole process, present some data access and arrangement issues which make the decoding flow more uncompact.

TABLE 1

| Classification | Function | MOPS[1)] |
|---|---|---|
| IQ | Degrouping | 0.88 |
| | Requantization | 1.44 |
| | Rescalzation | 0.96 |
| | | 3.28 |
| MC | Dematrixing | 0.576 |
| | Denormalization | 1.44 |
| | | 2.016 |
| Synthesis Subband Filter | IMDCT | 61.44 |
| | IPQMF | 19.22 |
| | | 81.36 |
| | Total | 86.656 |

[1)]MOPS: Million Operations per Second

SUMMARY OF THE INVENTION

In the present invention, we present a novel MPEG-II audio decoder, which is capable of decoding MPEG-II standard multichannel audio bitstreams for Layer I and II. This invention is also intended to show an efficient data arrangement and memory configuration for low complexity and low cost applications.

BRIEF DESCRIPTION OF THE DRAWINGS

FIG. 8 is a schematic plot showing the IPQMF memory data access order within a bank according to the present invention, wherein the dark blocks are accessed blocks and the blank blocks are non-accessed blocks.

DETAILED DESCRIPTION OF THE INVENTION

Figure 1:
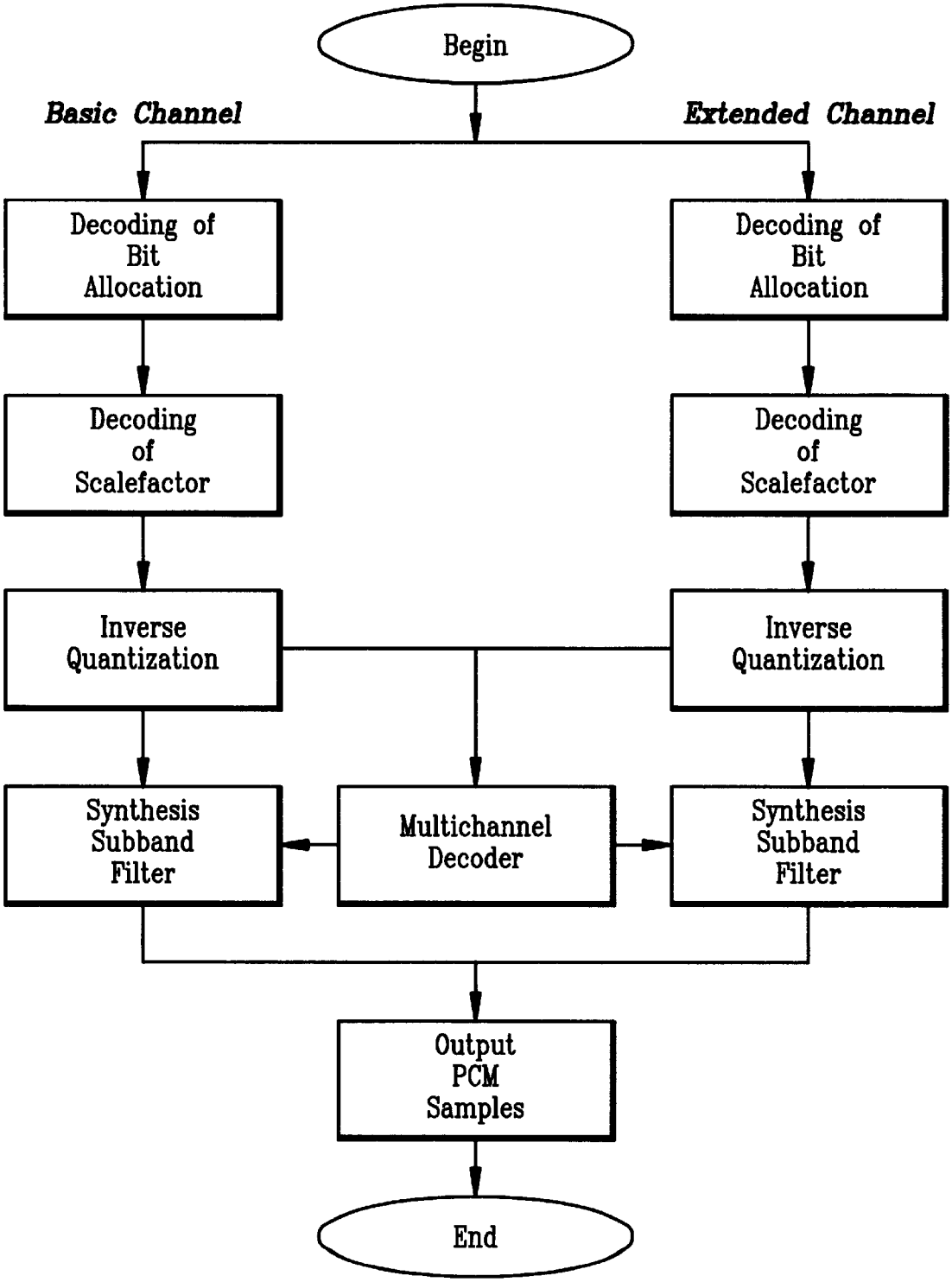
FIG. 1 (PRIOR ART)
FIG. 1 is a schematic block diagram showing a flow chart of MPEG-II decoding.
Figure 2:
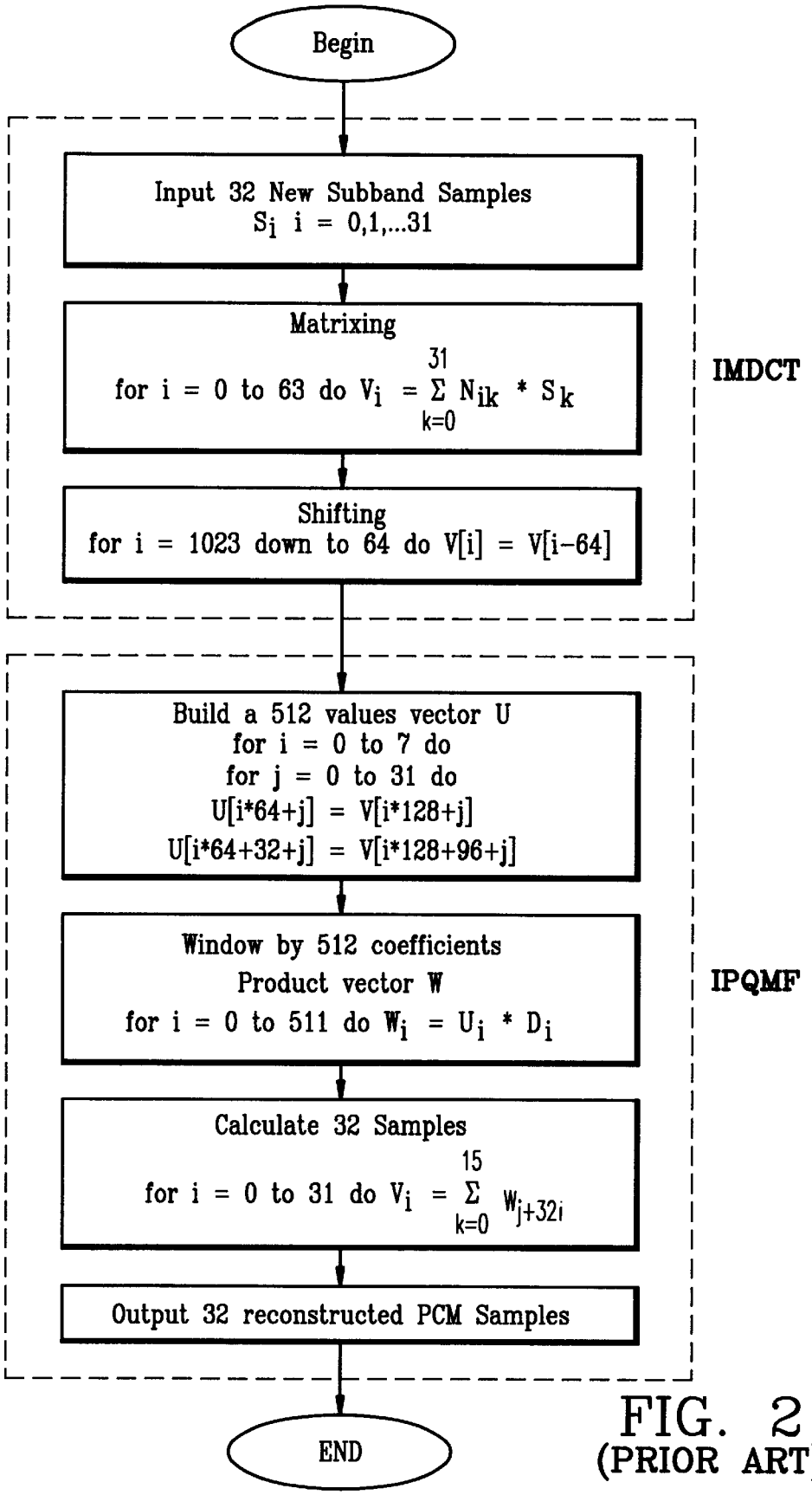
FIG. 2 (PRIOR ART)
FIG. 2 is a schematic block diagram showing a flow chart of the synthesis subband filter in FIG. 1.

Based on the approach of low computation, low cost and high performance, we propose a novel MPEG-II decoder with a modified decoding scheme for a synthesis subband filter module. Referring to the computation, the original IMDCT of a sequence $S_k$ is defined as follows:

$$V_i = \sum_{k-0}^{31} \cos\left[\frac{(16+i)(2k+1)\pi}{64}\right] * S_k \tag{1}$$

$$i = 0, 1, \ldots, 63$$

$$k = 0, 1, \ldots, 31$$

Wherein $S_k$ are subband samples, and $V_i$ are the audio samples.

Taking advantage of the symmetric properties $$\cos\theta = \cos(2\pi - \theta)$$

equation (1) can be represented as a matrix-vector multiplication form:

$$\begin{bmatrix} V_0 \\ V_1 \\ \vdots \\ V_{31} \\ V_{32} \\ \vdots \\ V_{63} \end{bmatrix} = \begin{bmatrix} \cos^{16,1} & \cos^{16,3} & \ldots & \cos^{16,31} & \cos^{16,32} & \ldots & \cos^{16,63} \\ \cos^{17,1} & \cos^{17,3} & \ldots & \cos^{17,31} & \cos^{17,32} & \ldots & \cos^{17,63} \\ \vdots & \vdots & \ddots & \vdots & \vdots & \ddots & \vdots \\ \cos^{47,1} & \cos^{47,3} & \ldots & \cos^{47,31} & \cos^{47,32} & \ldots & \cos^{47,63} \\ \cos^{48,1} & \cos^{48,3} & \ldots & \cos^{48,31} & \cos^{48,32} & \ldots & \cos^{48,63} \\ \vdots & \vdots & \ddots & \vdots & \vdots & \ddots & \vdots \\ \cos^{79,1} & \cos^{79,3} & \ldots & \cos^{79,31} & \cos^{79,32} & \ldots & \cos^{79,63} \end{bmatrix} \begin{bmatrix} S_0 \\ S_1 \\ \vdots \\ S_{31} \end{bmatrix}$$

-continued $$= \begin{bmatrix} \cos^{16,1} & \cos^{16,3} & \dots & \cos^{16,31} & \cos^{16,31} & \dots & \cos^{16,1} \\ \cos^{17,1} & \cos^{17,3} & \dots & \cos^{17,31} & -\cos^{17,31} & \dots & -\cos^{17,1} \\ \vdots & \vdots & \ddots & \vdots & \vdots & \ddots & \vdots \\ \cos^{47,1} & \cos^{47,3} & \dots & \cos^{47,31} & -\cos^{47,31} & \dots & -\cos^{47,1} \\ \cos^{48,1} & \cos^{48,3} & \dots & \cos^{48,31} & \cos^{48,31} & \dots & \cos^{48,1} \\ \vdots & \vdots & \ddots & \vdots & \vdots & \ddots & \vdots \\ \cos^{79,1} & \cos^{79,3} & \dots & \cos^{79,31} & -\cos^{79,31} & \dots & -\cos^{79,1} \end{bmatrix} \begin{bmatrix} S_0 \\ S_1 \\ \vdots \\ S_{31} \end{bmatrix}$$

wherein $$\cos^{i,k} = \cos\left[\frac{(16+i)(2k+1)\pi}{64}\right]$$

Therefore, we can obtain $$V_i = \sum_{k=0}^{31} \cos\left[\frac{(16+i)(2k+1)\pi}{64}\right] * [S_k + (-1)^i * S_{31-k}]$$

$$i = 0, 1, \dots, 63$$

$$k = 0, 1, \dots, 15$$

Further, in view of the following:

$$V_i = -V^{32-i} i = 0,1, \dots, 32$$

$$V_1 = -V^{96-i}, i = 33,34, \dots, 63$$

We can obtain:

$$Vi = \sum_{k=0}^{15} \cos\left[\frac{(16+i)(2k+1)\pi}{64}\right] * [S_k + (-1)^i * S_{31-k}] \quad (2)$$

$$i = 16, 17, \dots, 48$$

$$k = 0, 1, \dots, 15$$

$$= \sum_{k=0}^{15} \cos\left[\frac{(32+i)(2k+1)\pi}{64}\right] * [S_k + (-1)^i * S_{31-k}]$$

$$i = 0, 1, \dots, 32$$

$$k = 0, 1, \dots, 15$$

In the equation (2), $V_0=0$ and thus can be deleted. After readjusting the labeling index equation (2) can be transformed into a new equation (3) with a reduction of computation amount as follows:

$$V_i = \sum_{k=0}^{15} \cos\left[\frac{(32+i)(2k+1)\pi}{64}\right] * [S_k + (-1)^i * S_{31-k}] \quad (3)$$

$$i = 0, 1, \dots, 31$$

$$k = 0, 1, \dots, 15$$

Figure 3:
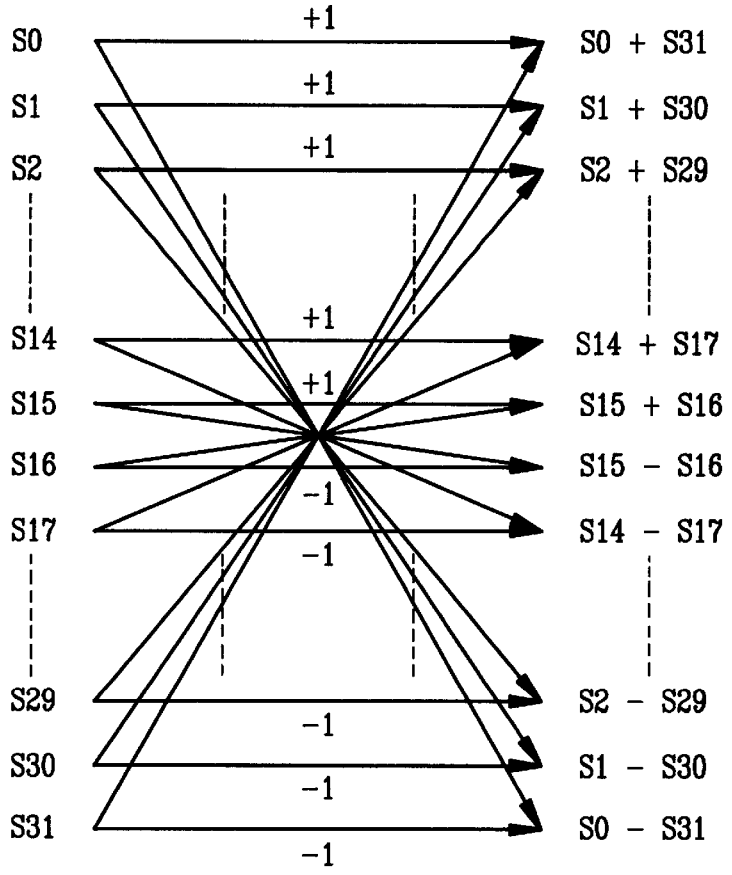
FIG. 3 is a schematic plot showing the butterfly stage of the fast IMDCT input data.

Equation (3) means the proposed fast IMDCT algorithm. It can be viewed as a butterfly input stage of the input sample, as illustrated in FIG. 3.

Figure 4:
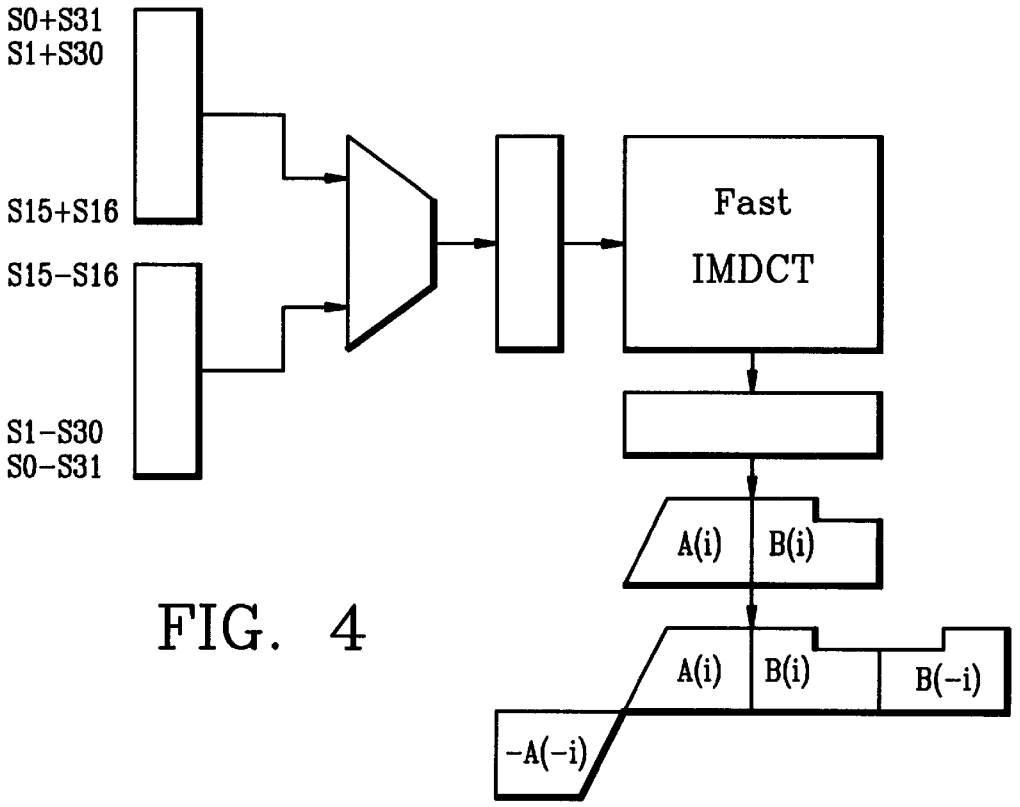
FIG. 4 is a schematic block diagram showing the algorithm of a fast IMDCT proposed in the present invention.

Referring to FIG. 4, the proposed fast IMDCT algorithm requires about ¼ the amount of multiplier-accumulate computation of the ISO suggestion method. Moreover, the required size for the synthesis subband buffer in which the QMF data $V_1$ stored can be reduced to only 512 words per channel, instead of the original size of 1024 words per channel.

Table 2 shows comparisons for the computation complexity and the required memory for the original and the algorithm proposed by in the present invention. Obviously, our proposed fast algorithm takes the advantages of low computation complexity and low memory size. Especially for the MPEG-II multichannel coding, the whole five channels take a large memory size for the synthesis subband buffer of 1024*5=5120 words. Half of the memory reduced within our fast IMDCT algorithm will make a single chip decoder implementation more feasible.

TABLE 2

| Function | Item | Original | Proposed | Proposed/Original |
|---|---|---|---|---|
| IMDCT | Multiply-accumulation per transform | 2048 | 512 | ¼ |
| IPQMF | Buffer size per channel | 1024 | 512 | ½ |

As to the IPQMF, the windowing operation is rewritten as follows:

$$W_i = U_1 * D_1, \ i = 0,1, \dots 511 \quad (4)$$

and the partial summation operation is shown by the following equation:

$$V_i = \sum_{k=0}^{15} W_{j+32i}, \ i = 0, 1, \dots 31 \quad (5)$$

Incorporating equation (4) to (5), we can obtain:

$$V_i = \sum_{j=0}^{15} Uj + 32i * Dj + 32, \ i = 0, 1, \dots 31 \quad (6)$$

wherein $V_i$ are the reconstructed PCM samples. It can be seen from equation (6) that the windowing and partial summation operations of IPQMF can be completed by using multiplier-accumulate computation together with an appropriate memory data access.

Figure 5:
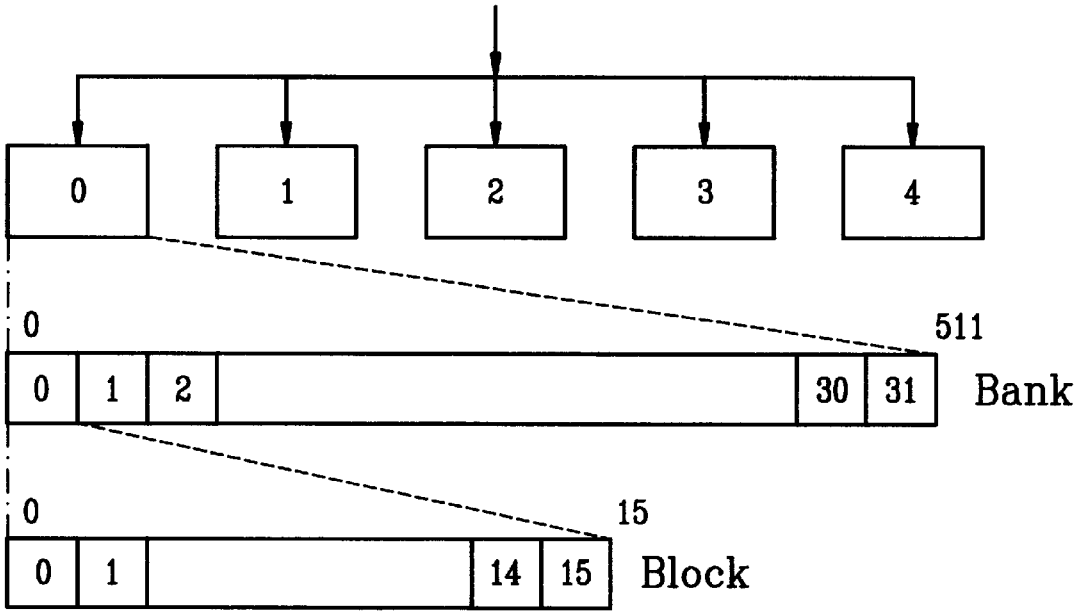
FIG. 5 is a schematic block diagram showing memory configuration for synthesis subband buffer for use in the present invention.

In addition, the synthesis subband buffer plays an important role in the synthesis subband process. Thus we take the efficient memory configuration for the synthesis subband buffer as shown in FIG. 5. This buffer can be divided into five individual memory banks. Each bank matches an audio channel data. The bank can be decomposed further into 32 blocks. Each block contains 16 audio samples.

Figure 6:
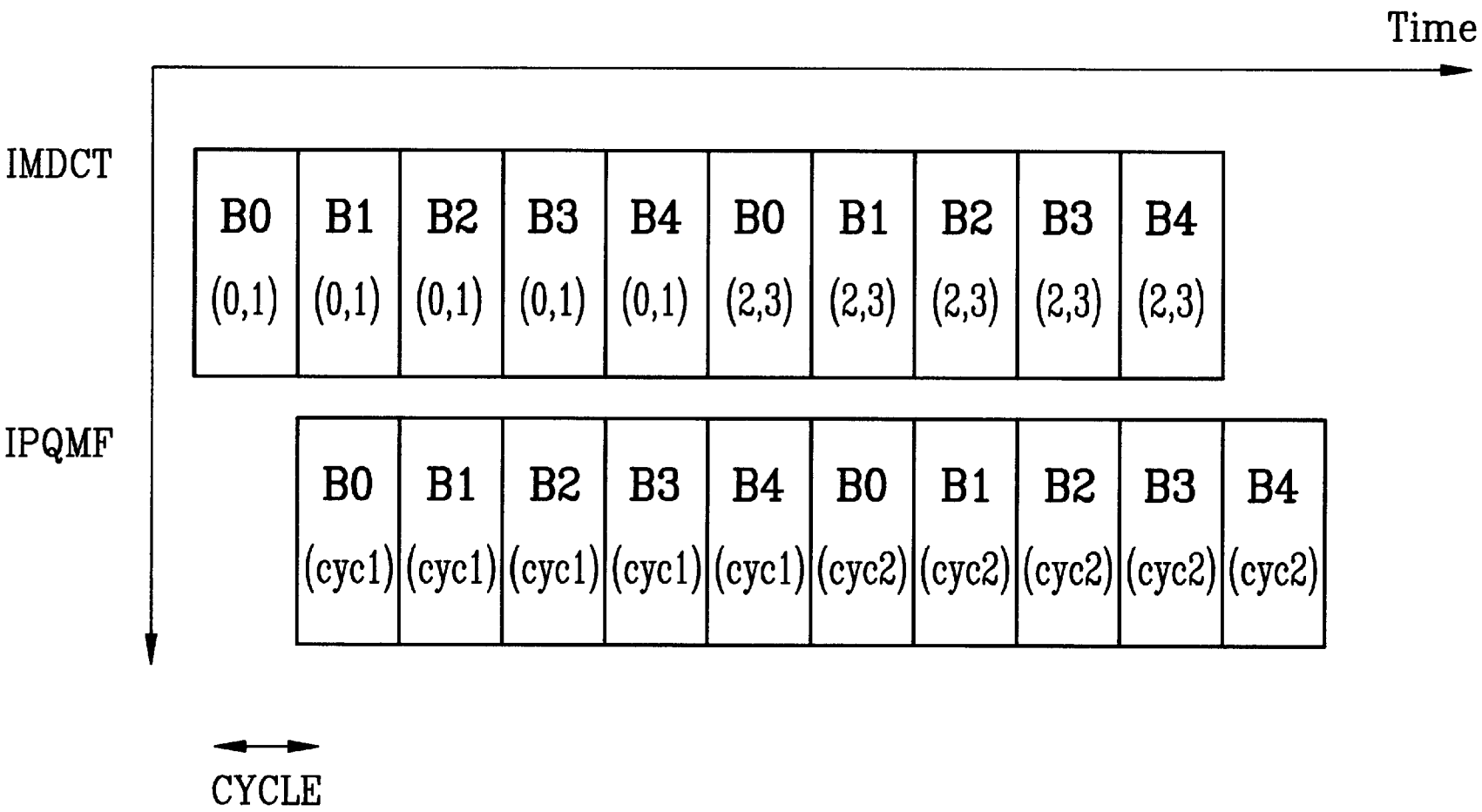
FIG. 6 is a schematic diagram showing pipeline processing for the fast IMDCT and the IPQMF according to the present invention.
Figure 7:
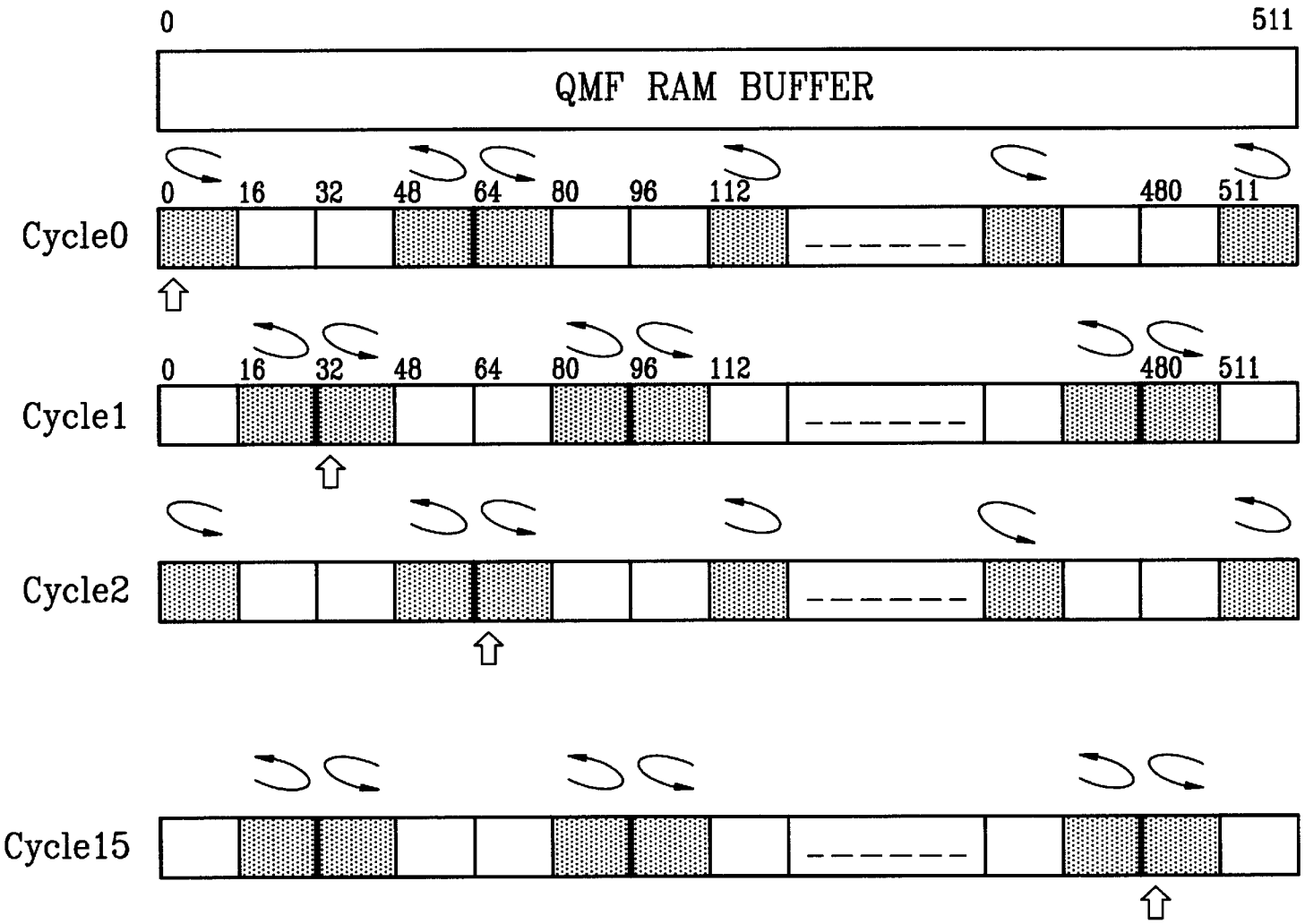
FIG. 7 is a schematic diagram showing the IPQMF memory data access order per audio channel according to the present invention.
Figure 9:
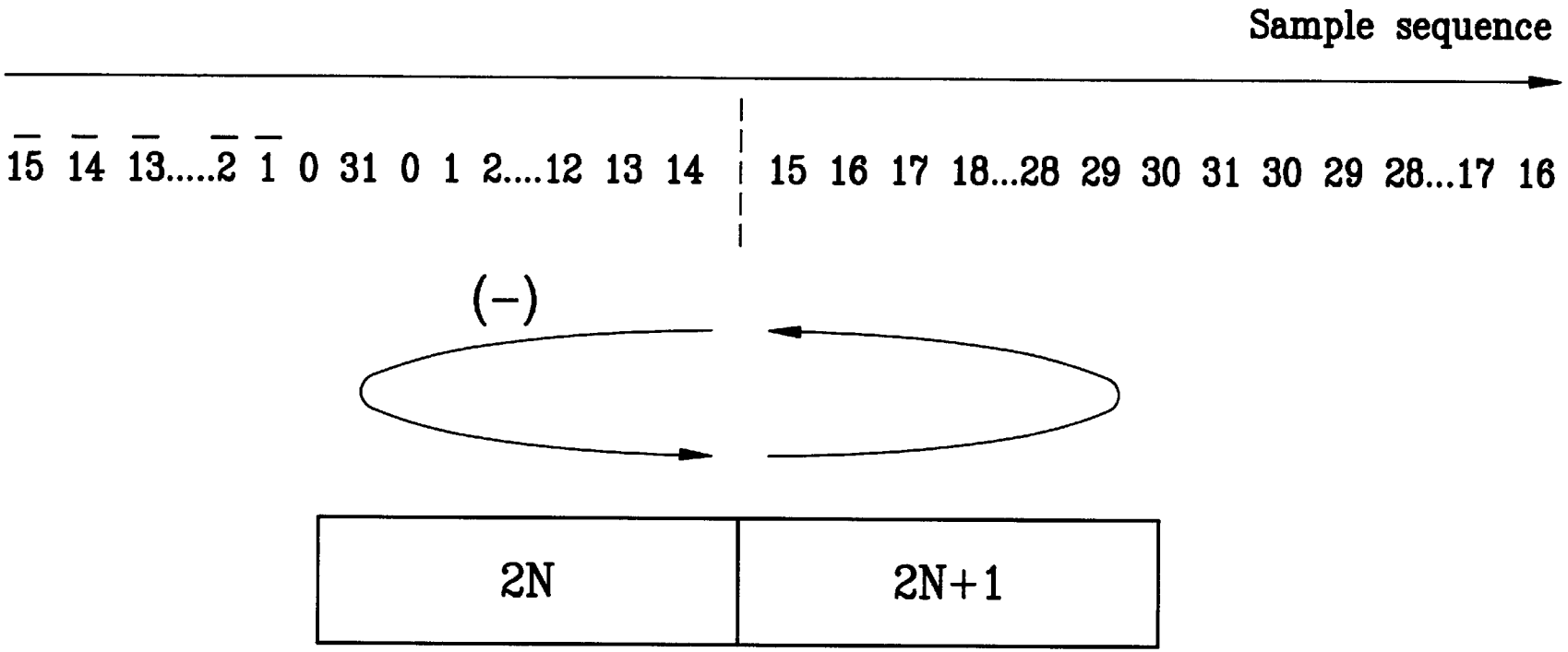
FIG. 9 is a schematic diagram showing the IPQMF memory data access within two blocks according to the present invention, wherein $\bar{k}$ means the accessed sample has to be complemented.

Based on the proposed algorithm, only 512 clock cycles, the 512 clock cycles being defined as a processing cycle, are required for computation of the IMDCT transform. Also, the IPQMF takes 512 clock cycles for a cycle. This makes the pipeline processing with IMDCT and IPQMF modules highly efficient as shown in FIG. 6. In each cycle, the data processed from IMDCT are written into the synthesis subband buffer with two blocks. In the meantime, the IPQMF module reads the data from the buffer with some blocks. The memory access for IPQMF can be realized by an address generator 100. The operation of the IPQMF memory data access per audio channel is illustrated in FIG. 7. This implies the access order of the blocks within a bank must be followed as shown in FIG. 8, wherein the IPQMF cycles 16 to 31 (not shown in the drawing) will repeat the access order of the blocks of the IPQMF cycles 0 to 15, and so on. Two pointers address the start and end blocks to realize a circular buffer for the IPQMF shifting. The access order of the samples within two blocks is illustrated in FIG. 9. The data addressing order in a block having an even sequence number is backward addressing and then forward addressing, wherein the samples have to be complemented during the backward addressing. The data addressing order in a block having an odd sequence number is forward addressing and then backward addressing. These data addressing orders are based on the characteristics of the half memory size of the proposed fast algorithm.

What is claimed is:

1. A synthesis subband filter process in MPEG-II audio decoding, wherein five multichannel signals are encoded according to the MPEG-II standard, said process comprising the following steps:

a) subjecting 32 subband samples to an Inverse Modified Discrete Cosine Transform (IMDCT) per audio channel according to the following equation (3):

$$V_i = \sum_{k=0}^{15} \cos\left[\frac{(32+i)(2k+1)\pi}{64}\right] * [S_k + (-1)^i * S_{31-k}] \tag{3}$$

$$i = 0, 1, \cdots, 31$$

$$k = 0, 1, \cdots, 15$$

wherein Sk are the subband samples, and Vi are audio samples resulting from the transformation, and wherein 512 clock cycles are required to generate 32 said audio samples Vi, said 512 clock cycles defining a processing cycle;

b) providing a synthesis subband buffer having five banks, each bank matching an audio channel and having 32 blocks, and each block being adapted to store 16 said audio samples;

c) writing 32 said audio samples Vi into two of said blocks within said bank; and d) reading data from a plurality of said blocks and undergoing an Inverse Pseudo Quadrature Mirror Filter (IPQMF) operation to obtain a reconstructed PCM sample output, wherein an address generator is used to generate a starting block pointer and an ending block pointer per cycle, so that said plurality of blocks are selected and read according to a block access order as follows:

Starting Block ↓ Ending Block ↓

| | | | | | | | | | | | | | | | | |
|---|---|---|---|---|---|---|---|---|---|---|---|---|---|---|---|---|
| IPQMF cycle0 | 0 | 3 | 4 | 7 | 8 | 11 | 12 | 15 | 16 | 19 | 20 | 23 | 24 | 27 | 28 | 31 |
| IPQMF cycle1 | 2 | 5 | 6 | 9 | 10 | 13 | 14 | 17 | 18 | 21 | 22 | 25 | 26 | 29 | 30 | 1 |
| IPQMF cycle2 | 4 | 7 | 8 | 11 | 12 | 15 | 16 | 19 | 20 | 23 | 24 | 27 | 28 | 31 | 0 | 3 |
| IPQMF cycle3 | 6 | 9 | 10 | 13 | 14 | 17 | 18 | 21 | 22 | 25 | 26 | 29 | 30 | 1 | 2 | 5 |
| . | . | | | | | | | | | | | | | | | |
| . | . | | | | | | | | | | | | | | | |
| . | . | | | | | | | | | | | | | | | |
| IPQMF cycle14 | 28 | 31 | 0 | 3 | 4 | 7 | 8 | 11 | 12 | 15 | 16 | 19 | 20 | 23 | 24 | 27 |
| IPQMF cycle15 | 30 | 1 | 2 | 5 | 6 | 9 | 10 | 13 | 14 | 17 | 18 | 21 | 22 | 25 | 26 | 29 |

Block Sequence wherein the block access order is repeated per 16 cycles, wherein the data addressing order in a block having an even sequence number is accessed by backward addressing and then by forward addressing, wherein the samples are complemented during the backward addressing, and wherein the data addressing order in a block having an odd sequence number is accessed by forward addressing and then by backward addressing.

* * * * *